US006199687B1

(12) United States Patent
Tambo et al.

(10) Patent No.: US 6,199,687 B1
(45) **Date of Patent: *Mar. 13, 2001**

(54) TONGUE LID PACK AND BLANK FOR PACK

(75) Inventors: Hitoshi Tambo; Makoto Sendoh; Kenichi Yamashita, all of Tokyo (JP)

(73) Assignee: Japan Tobacco Inc., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/124,897

(22) Filed: Jul. 30, 1998

(30) Foreign Application Priority Data

Aug. 4, 1997 (JP) ..... 9-209141

(51) Int. Cl.[7] ..... B65D 85/10

(52) U.S. Cl. ..... 206/268; 206/273; 229/149; 229/160.1

(58) Field of Search ..... 206/269, 271, 206/273, 268; 229/160.1, 149, 152

(56) References Cited

U.S. PATENT DOCUMENTS

| | | | | |
|---|---|---|---|---|
| 183,466 | * | 10/1876 | Pearl | 229/149 X |
| 624,583 | * | 5/1899 | Vierengel | 229/149 |
| 1,432,932 | * | 10/1922 | Weis | 229/149 X |
| 1,433,439 | * | 10/1922 | Weis | 229/149 |
| 1,866,130 | * | 7/1932 | Reichel | 229/149 X |
| 2,290,359 | * | 7/1942 | Ringler | 229/149 X |
| 2,316,796 | * | 4/1943 | Lichter | 229/149 X |
| 2,762,553 | * | 9/1956 | Bentz | 229/149 X |
| 3,861,583 | * | 1/1975 | Tingley et al. | 229/149 X |
| 4,300,676 | * | 11/1981 | Focke et al. | 206/264 |
| 4,949,841 | * | 8/1990 | Foche et al. | 206/273 X |
| 5,123,589 | * | 6/1992 | Cote | 229/149 X |
| 5,511,658 | * | 4/1996 | Focke et al. | 206/271 |
| 5,553,773 | * | 9/1996 | Focke et al. | 206/273 X |

FOREIGN PATENT DOCUMENTS

| | | | | |
|---|---|---|---|---|
| 0012937 | * | 7/1895 | (GB) | 229/149 |

* cited by examiner

*Primary Examiner*—Bryon P. Gehman
(74) *Attorney, Agent, or Firm*—Birch, Stewart, Kolasch & Birch, LLP

(57) ABSTRACT

A tongue lid pack includes a body containing a packing article of filter cigarettes, and a cutting line is formed on the front wall of the body. A tongue lid is hingedly connected to the opening end of the body, and the tongue lid has a lid portion for closing and opening the opening end and a tongue extending from the lid portion and a bent tip. When the tongue lid is closed, the bent tip of the tongue is inserted through the cutting line of the front wall. Also, a blank for the tongue lid pack and a method for folding the blank are disclosed.

13 Claims, 9 Drawing Sheets

TONGUE LID PACK AND BLANK FOR PACK

BACKGROUND OF THE INVENTION

1. Field of the Invention

The present invention relates to a tongue lid pack for filter cigarettes, a blank for forming the pack, and a method for forming the pack from the blank.

2. Description of the Related Art

In order to contain 20 filter cigarettes, a hinged lid pack is generally used. This pack is hard as compared with the soft pack, and can protect the filter cigarettes therein from an external force appropriately.

For forming the above hinged lid pack, a main blank for a pack body having a lid and a sub-blank for an inner frame are needed. In view of an effective use of sources, the use of the hinged lid pack is not favorable.

SUMMARY OF THE INVENTION

An object of the present invention relates to a tongue lid pack, which can be formed from one blank, a blank for forming the pack, and a method for forming the pack from the blank.

The above object can be attained by a tongue lid pack of the present invention. The pack comprises: a body for containing a packing article, the body having a front wall, an opening end, and a cutting line formed on the front wall; and a tongue lid hingedly connected to the opening end, the tongue lid including a lid portion for opening and closing the opening end, and a tongue extending from the lid portion and being insertable through the cutting line, and the tongue having a bent tip portion.

According to the tongue lid pack, when the tongue lid is closed, the bent tip portion of the tongue is inserted in to the body through the cutting line while the front wall is partially deformed.

Preferably, the cutting line is curved convexedly to the opening end of the body, or a tip edge of the tongue is curved convexedly. In this case, when the tongue lid is closed, the tip edge thereof abuts the edge of the cutting line in a point contact state, so that the tip edge of the tongue is more smoothly inserted into the body.

The body can further include a pair of side end flaps at opening edges of the opening end. At the time of forming the tongue lid pack, the side end flaps are useful to position the packing article and to increase rigidity of the body.

The packing article includes an envelope, and a part of the envelope, which is exposed from the front wall, is separable. In this case, the cutting line is preferably positioned at a lower side than the part of the envelope. Even if the part of the envelope is separated, the tip of the tongue does not catch on the separated edge of the envelope when the tongue is inserted in to the body.

The blank for the tongue lid pack includes a section array. The section array has a front wall section with the cutting line, a bottom wall section, and a rear wall section which serve as a front wall of the body, a bottom wall, and a rear wall, respectively. These sections stretch in line through the folding lines. A top flap, serving as a tongue lid, is connected to an end of the rear wall section through a folding line. A pair of inner side flaps, serving as linings for side walls, are connected to both side edges of the rear wall section through folding lines. A pair of outer side flaps, serving as side walls for the body, are connected to both side edges of the front wall section through folding lines. A pair of inner bottom flaps, serving as linings for the bottom wall of the body, are arranged between the inner side flaps and the outer side flaps. These flaps are connected to the inner side flaps through folding lines.

The above blank is formed to the tongue lid pack containing a packing article while the flaps and the sections are sequentially folded. The tip portion of the top flap is already bent before the front wall section and the top flap are folded. Therefore, when the front wall section and the top flap are folded, the bent tip of the top flap is inserted through the cutting line of the front wall section.

The inner side flaps may be folded either before or after the packing article is supplied to the rear wall section.

Further scope of applicability of the present invention will become apparent from the detailed description given hereinafter. However, it should be understood that the detailed description and specific example, while indicating preferred embodiment of the invention, are given by way of illustration only, since various changes and modifications within the sprit and scope of the invention will become apparent to those skilled in the art from this detailed description.

BRIEF DESCRIPTION OF THE DRAWINGS

The present invention will become more fully understood from the detailed description given hereinbelow and the accompany drawings which are given by way of illustration only, and thus, are not limitative of the present invention, and wherein.

DETAILED DESCRIPTION OF THE PREFERRED EMBODIMENTS

Figure 1:
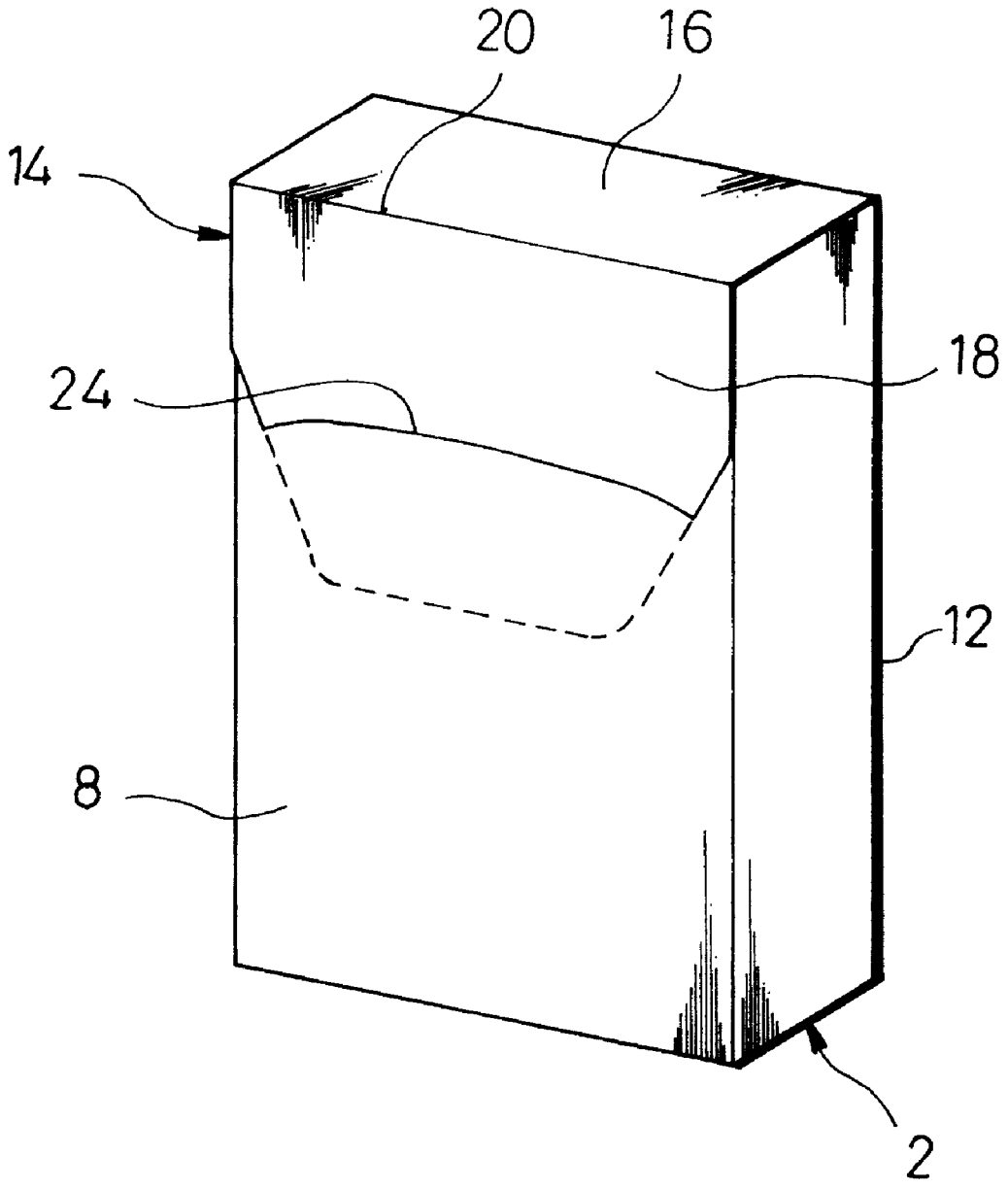
FIG. 1 is a perspective view of a tongue lid pack in a state in which the lid is closed.
Figure 2:
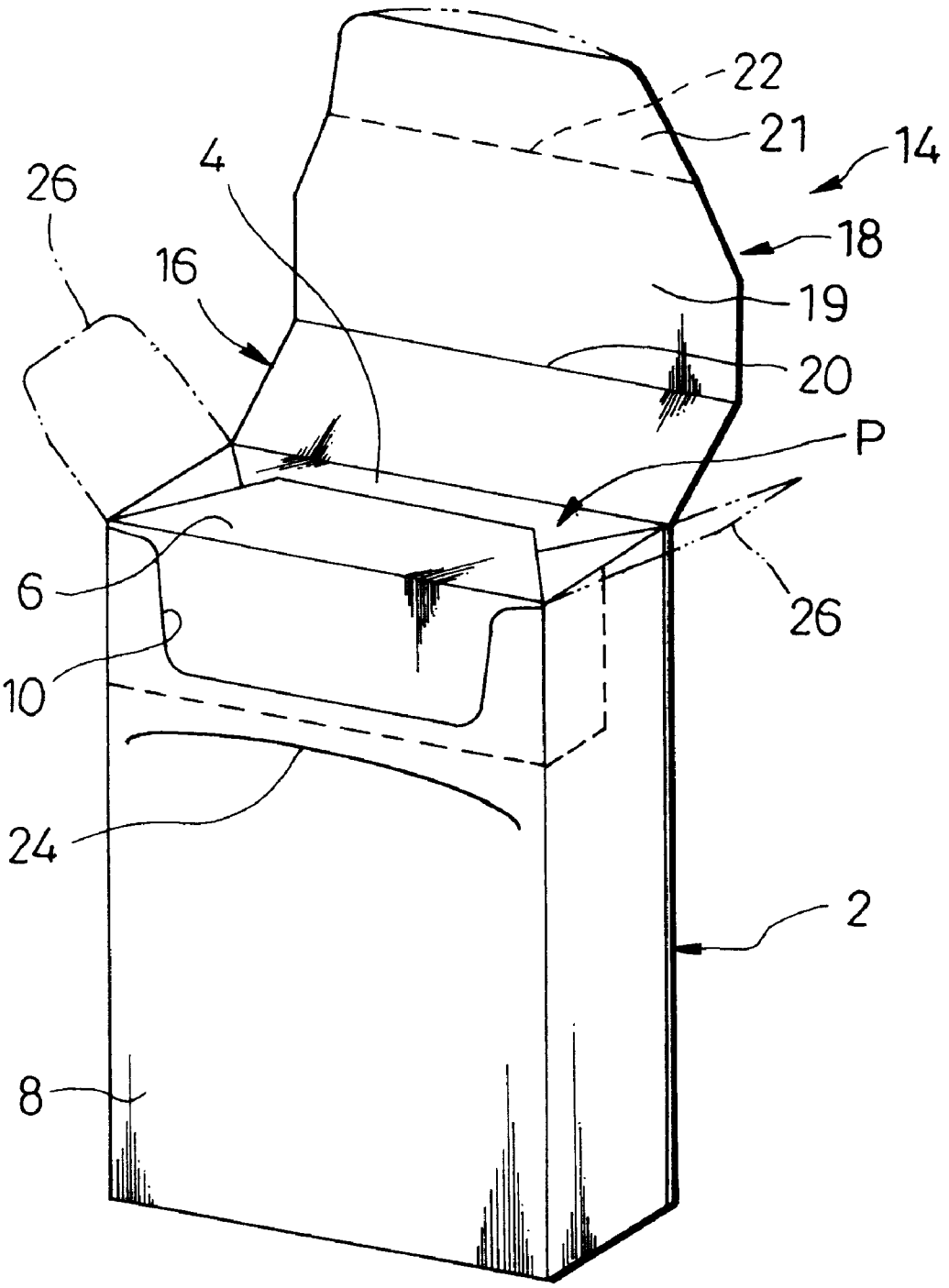
FIG. 2 shows a state in which the pack of FIG. 1 is closed.

Referring to FIGS. 1 and 2, a tongue lid pack for filter cigarettes comprises a box-shaped body 2. The body 2 is opened at its upper end. In the body 2, a packing article P is contained. In this case, the packing article P has 20 filter cigarettes bundled by an envelope 4. A part 6 of the envelope 4 can be separated from a separating line shown by a dash-single-dot line so as to expose the filter cigarettes in the packing article P.

A front wall 8 of the body 2 has a U-shaped cutout 10 at its upper edge portion, and the cutout 10 makes it easy to take out the filter cigarettes from the body 2.

The body 2 has a rear wall 12 and a tongue lid 14 is hingedly connected to the upper edge of rear wall 12. The tongue lid 14 has a lid portion 16, and a tongue 18 extending from the lid portion 16. A folding line 20 is formed between the lid portion 16 and the tongue 18. The shape and size of the lid portion 16 are substantially the same as those of the opening end of body 2, and the opening end can be completely covered with the lid portion 16.

The tongue 18 has a root 19 and a taper tip 21. The root 19 extends from the lid portion 16 such that it has the same width as the lid portion 16. Thereafter, the width of the root 19 is gradually decreased toward the tip 21. When the tongue lid 14 is closed, the root 19 can completely cover the cutout 10.

A bending line 22 (FIG. 2) is formed between the root 19 and the tip 21, and the tip 21 is bent inwardly from the bending line 22.

The front wall 8 further has a cutting line 24 at a lower side of the cutout 10, more specifically a lower side than the part 6 of envelope 4. The cutting line 24 extends in a width direction of the front wall 8, and is curved convexedly toward the opening end of body 2.

In FIG. 2, as shown by a dash-double-dot line, the body 2 may have side end flaps 26 at upper edges of both side walls through folding lines, respectively. When these side end flaps 26 are folded toward the upper surface of packing article P, the packing article P is sandwiched between a bottom wall of the body 2 and the flaps 26. The flaps 26 are not indispensable members.

As shown in FIG. 1, when the tongue lid 14 is closed, the tip 21 of tongue 18 is inserted into the body 2 through the cutting line 24 of front wall 8, and sandwiched between the front wall 8 and the packing article P. In a case where the body 2 has the flaps 26, the flaps 26 are folded before the tongue lid 14 is closed.

The tip 21 of the tongue 18 is bent inwardly from the bending line 22. Due to this, when the tongue lid 14 is closed, the tip 21 presses a portion between the cutting line 24 and the cutout 10 so that the portion is dented inwardly. Therefore, the edge of curved cutting line 24 is exposed, and the tip 21 abuts the edge in a point contact state. This abutment bends the tip 21 more inwardly, and opens the cutting line 24, thereby the tip 21 is slightly inserted into the body 2 through the cutting line 24. If the tip 21 is slightly inserted in this way, the tip 21 can be more deeply and smoothly inserted into the body 2.

The cutting line 24 is positioned at the lower side than the part 6 of envelope 4. For this reason, even if the part 6 is cut from the envelope 4, the tip 21 of tongue 18 does not catch on the edge of envelope 4, and the envelope does not inhibit the insertion of tip 21.

When the tongue 18 of tongue lid 14 is pushed up from the state of FIG. 1, the tongue 18 can be easily pulled out from the cutting line 24 and the tongue 14 is opened as shown in FIG. 2.

As shown by the dash-double-dot line of FIG. 2, an insertion edge of the tip 21 may be curved convexedly. In this case, the insertion of tip 21 can be more easily performed.

Figure 3:
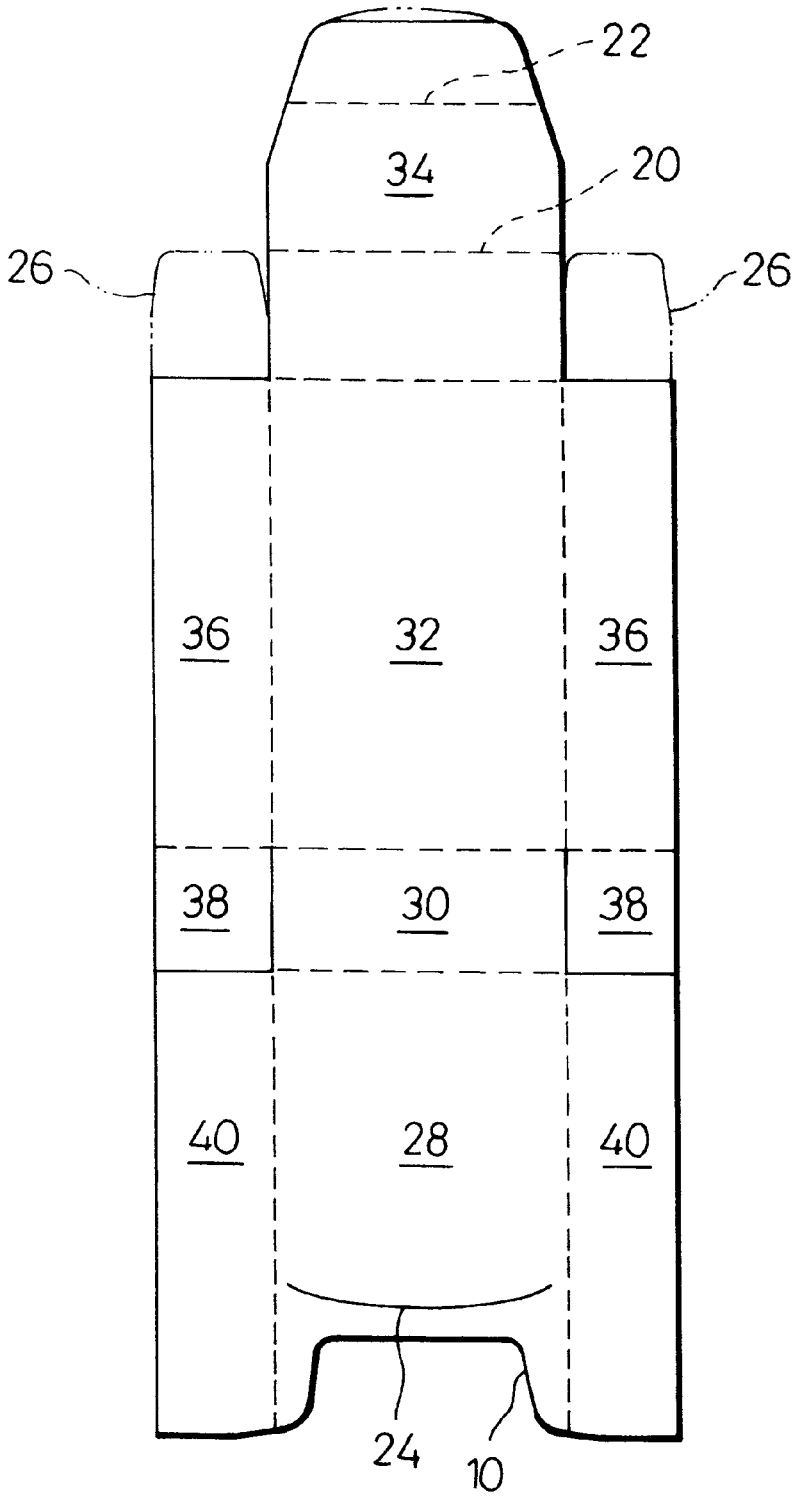
FIG. 3 is a plane view of a blank for forming the pack of FIG. 1.

The tongue lid pack is formed from one blank shown in FIG. 3. The blank has sections 28, 30, and 32 which serve as the front wall 8, the bottom wall, and the rear wall 12, respectively. These sections stretch in line through folding lines shown by broken lines, thereby forming a section array.

A top flap 34, serving as the tongue lid 14, extends from the section 32 through a folding line. Inner side flaps 36, serving as linings for the side walls of body 2, are continuous with both side edges of the section 32 through the folding lines, respectively.

An inner bottom flap 38 is continuous with an edge of each flap 36 through a folding line. These inner bottom flaps 38 are adjacent to both sides of the section 30, and used as linings for the bottom wall of the body 2.

The side end flap 26 is connected to the other end edge of each flap 36 through a folding line as required.

Outer side flaps 40, serving as the side walls of body 2, are continuous with both side edges of section 28 through folding lines. The section 28 has the cutting line 24, and the flap 34 has the folding line 20 and the bending line 22.

A method for forming the tongue lid pack from the blank of FIG. 3 will be explained. The known packing machine can be used to form the tongue lid pack.

Figure 4:
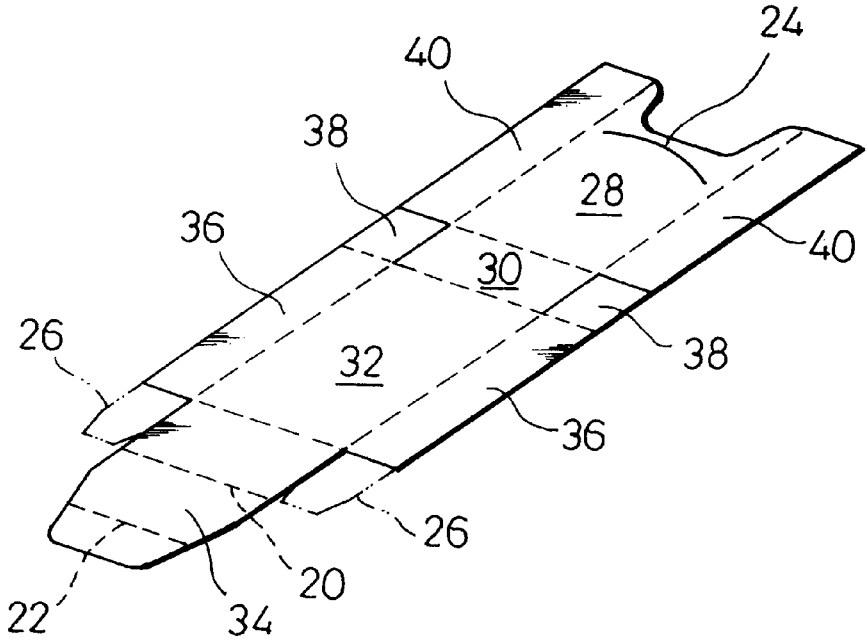
FIG. 4 is a perspective view of the blank of FIG. 3.

FIG. 4 shows the blank, which has just been supplied to the packing machine, and paste is applied onto the sections 28, 32, and 40.

Figure 5:
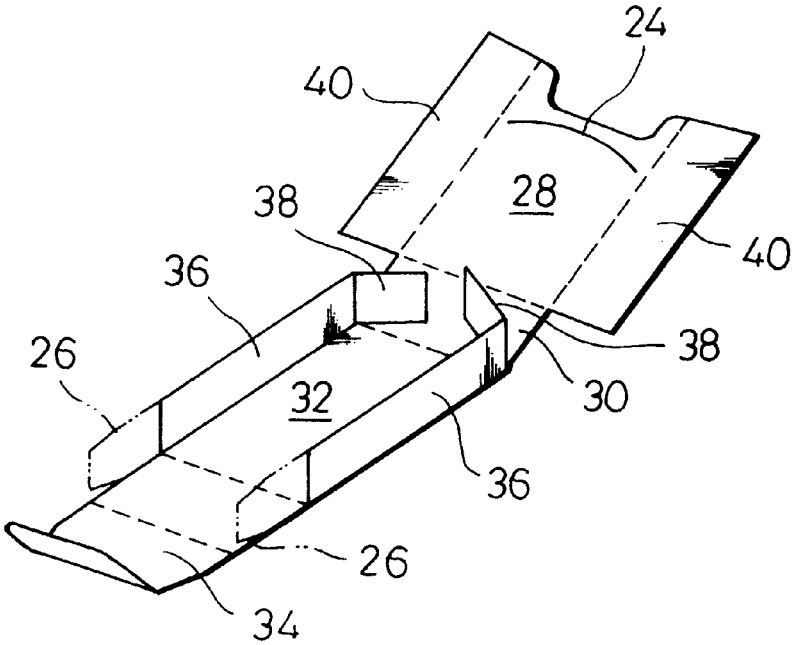
FIG. 5 shows the folding of blank from the state of FIG. 4.

As shown in FIG. 5, both flaps 36 are folded with the flaps 38 (and flaps 26) along the folding lines between the flaps 36 and the section 32 so as be opposite to each other.

Figure 6:
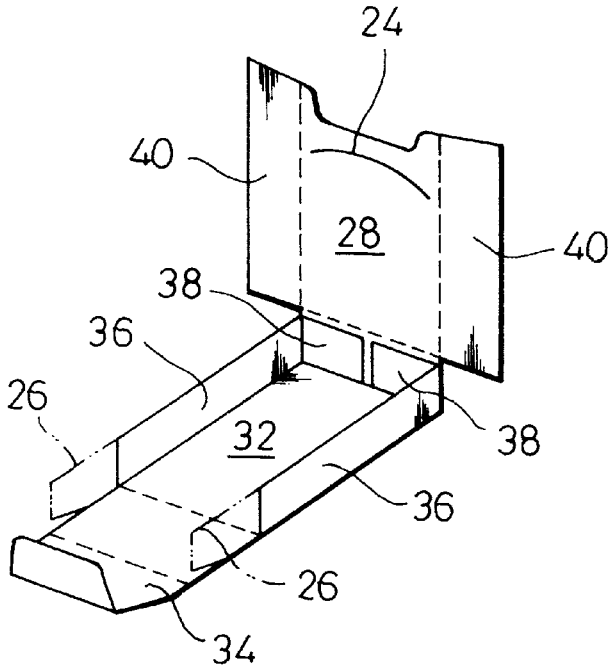
FIG. 6 shows the folding of blank from the state of FIG. 5.
Figure 7:
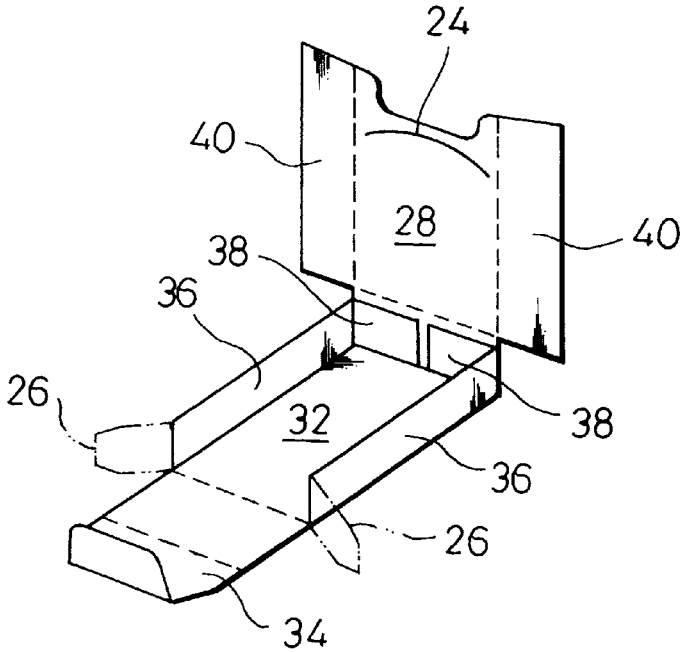
FIG. 7 shows the folding of blank from the state of FIG. 6.

At the same time with the folding of flaps 36, the tip portion of flap 34 is bent from the bending line 22. Thereafter, both flaps 38 are folded, and then the section 30 is folded to the flaps 38 together with the section 28 and both flaps 40. As a result, as shown in FIG. 6, the section 30 is superimposed on the flaps 38, and the section 28 and the flaps 40 rise perpendicularly with respect to the section 32. In a case where the flaps 36 have flaps 26, both flaps 26 are bent outwardly (FIG. 7).

Figure 8:
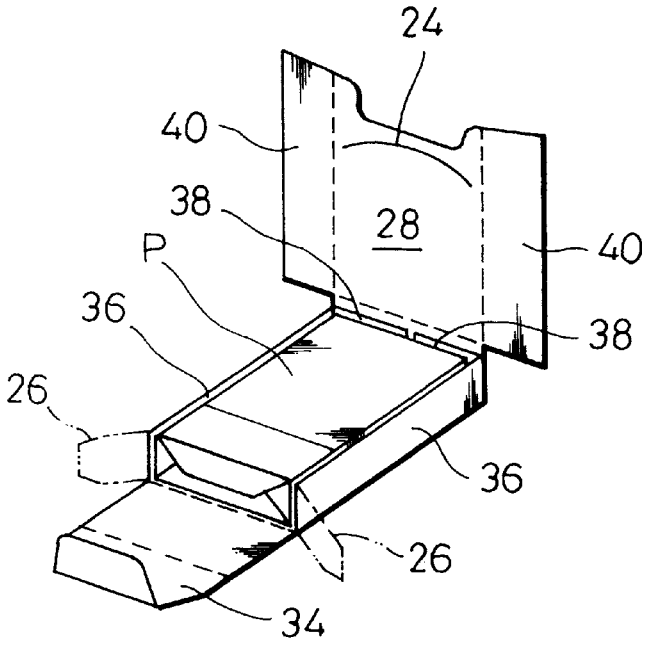
FIG. 8 shows a state in which a packing article is provided to the blank of FIG. 7.

Thereafter, as shown in FIG. 8, the packing article P is supplied on the section 32, and sandwiched between the flaps 36. The packing article P can be inserted along the flaps 36 until the article P gets over the bent tip portion of flap 34 and comes in contact with the flaps 38 from the opening defined between the flaps 36.

Figure 9:
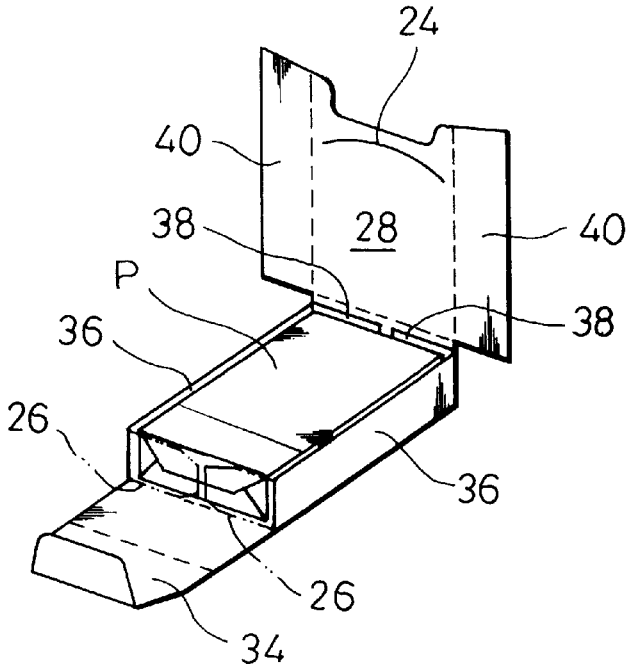
FIG. 9 shows the folding of blank from the state of FIG. 8.

In a case where the flaps 36 has the flaps 26, these flaps 26 are folded inwardly, and the packing article P is sandwiched between the flaps 26 and the flaps 38 (FIG. 9).

The packing article P is adhered to the section 32 with paste. However, since paste on the section 32 is not fully dried at this time, adhesive strength of the packing article P is poor. For this reason, when the packing article P is sandwiched between the flaps 26 and the flaps 38, unnecessary movement of the packing article P on the section 32 can be prevented, and the correct positioning of packing article P can be achieved.

Figure 10:
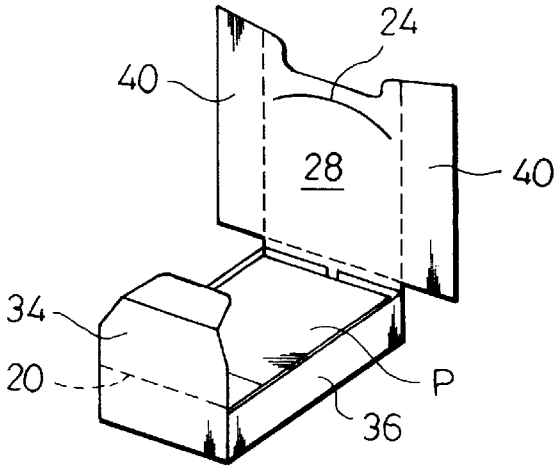
FIG. 10 shows the folding of blank from the state of FIG. 9.

As shown in FIG. 10, the flap 34 is folded by a predetermined angle from the folding line (that is, self-hinge for the tongue lid 14) between the flap 34 and the section 32. Thereafter, the section 28 is folded toward the upper surface of packing article P together with the flaps 40, and the flap 34 is further folded at the same time. As a result, the portion of the flap 34, which corresponds to the lid portion 16, is pressed to the end surface of packing article P, and folded to the upper surface of packing article P from the folding line 20.

Figure 11:
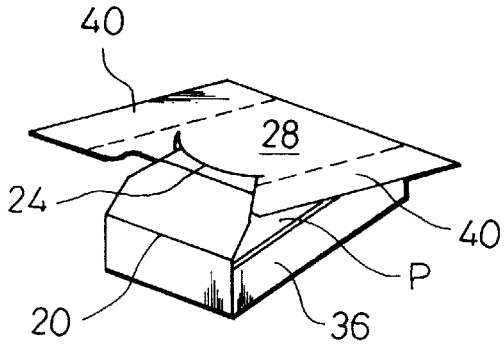
FIGS. 11 and 12 sequentially show the process in which the blank is folded from the state of FIG. 10.

The tip portion of the flap 34 is already bent from the bending line 22, and the cutting line 24 of the section 28 is curved convexedly with respect to the tip edge of flap 34. As shown in FIG. 11, the tip edge of flap 34 abuts the edge of cutting line 24 so as to open the cutting line 24. As a result, the tip of flap 34 is inserted through the cutting line 24, and the section 28 and the flap 34 are overlapped with each other on the packing article P. Since paste is applied onto the section 28, the section 28 is adhered to the packing article P.

Thereafter, both flaps 40 are folded and superimposed on the corresponding flaps 36 outwardly. Since paste is also applied onto the flaps 40, the flaps 40 and 36 are adhered to each other. At this time, the forming of the tongue lid pack containing the packing article P is completed.

The completed tongue lid pack is supplied to a film packing machine, and packed with a film in the film packing machine.

FIGS. 13 to 16 show processes in which the tongue lid pack is formed from the blank of FIG. 3 using a different known packing machine.

Figure 13:
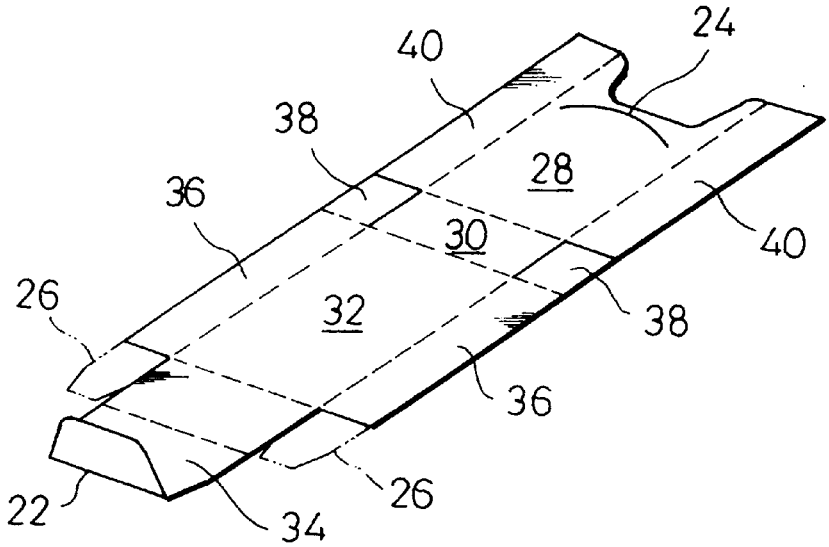
FIG. 13 shows a different folding of the blank from the state of FIG. 4.
Figure 14:
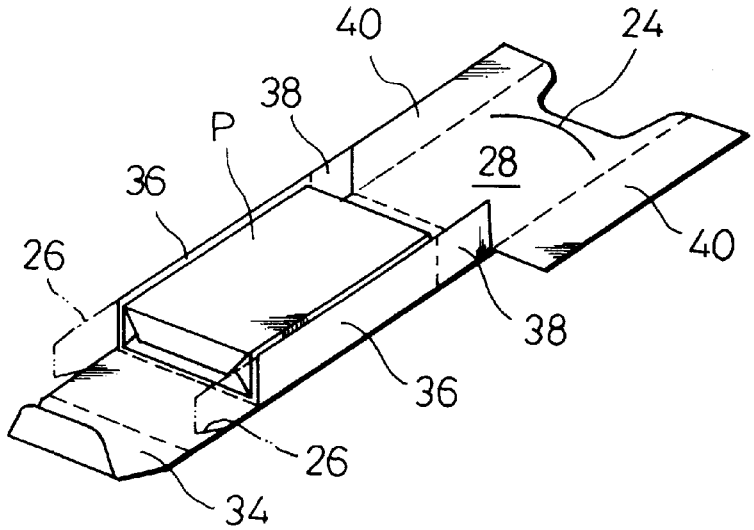
FIG. 14 shows the supply of packing article to the blank in the state of FIG. 13, and the folding of the blank.

First, as shown in FIG. 13, the tip portion of flap 34 is bent from the bending line 22. Thereafter, the packing article P is supplied on the section 32, and both flaps 36 are folded toward both side faces of packing article P. Therefore, as shown in FIG. 14, the packing article P is sandwiched between the flaps 36.

Figure 15:
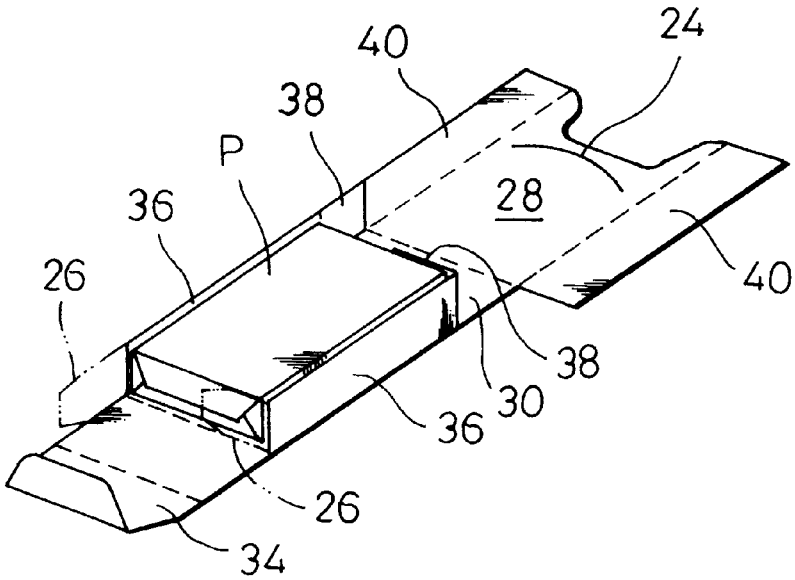
FIG. 15 shows the folding of blank from the state of FIG. 14.
Figure 16:
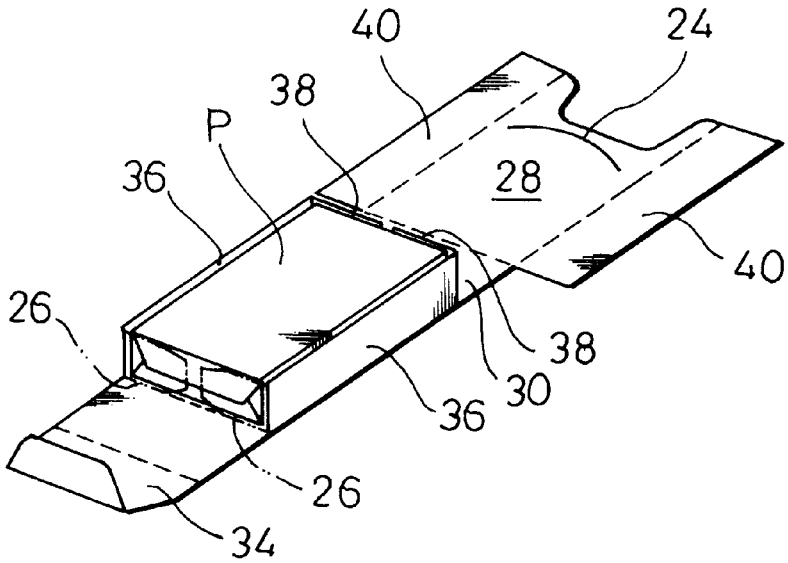
FIG. 16 shows the folding of blank from the state of FIG. 15.

Thereafter, as shown in FIG. 15, one flap 38 (and one flap 26) is folded toward the end face of packing article P. Similarly, the other flap 38 (and the other flap 26) is folded (FIG. 16).

Figure 12:
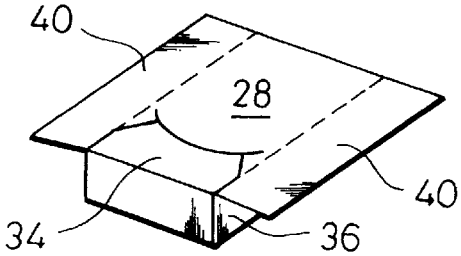

After this, the section 30 is folded with the section 28 and the flaps 40, and the flap 34 is folded at the same time. Then, the folding is sequentially carried out in the same manner as shown in FIGS. 10, 11, and 12, and the forming of the tongue lid pack is completed.

The invention being thus described, it will be obvious that the same may be varied in many ways. Such variations are not to be regarded as a departure from the spirit and scope of the invention, and all such modifications as would be obvious to one.

What is claimed is:

1. A tongue lid pack containing a packed article, the packed article including an envelope having a tear portion defined by a separating line, said pack comprising:

a body for surrounding the packed article so as to locate the separating line of the packed article therein, said body having a front wall, a top opened end for exposing a part of the tear portion of the envelope, and a cutting line formed on the front wall at a lower side than the separating line of the envelope; and a tongue lid hingedly connected to the top opened end, said tongue lid including a lid portion for opening and closing the top opened end, and a tongue extending from the lid portion and being insertable through the cutting line, and the tongue having a bent tip portion, said tongue and said lid portion being separated by a folding line and said bent tip portion is formed by a bending line located between the folding line and a tip edge of the tongue.

2. The pack according to claim 1, wherein the cutting line is curved convexedly to the top opened end.

3. The pack according to claim 1, wherein said tip edge is curved convexedly.

4. The pack according to claim 2, wherein said tip edge is curved convexedly.

5. The pack according to claim 1, wherein said body further includes a pair of side walls, a bottom wall, a rear wall, and a pair of side end flaps connected to top edges of said side walls, respectively, the top edges defining a part of the top opened end.

6. A blank for forming a tongue lid pack, the tongue lid pack for containing a packed article which includes an envelope having a tear portion defined by a separating line, said blank comprising:

a section array including a front wall section with a cutting line, a bottom wall section, and a rear wall section, said sections for serving as a front wall, a bottom wall, and a rear wall of a body of the tongue lid pack, respectively, and stretching in line through folding lines, wherein the body serves for surrounding the packed article so as to locate the separating line of the packed article therein and has a top opened end for exposing a part of the tear portion of the envelope and the cutting line is formed on the front wall section so as to be positionable at a lower side than the separating line;

a top flap connected to an end of said rear wall section through a folding line, said top flap serving as a tongue lid of the tongue lid pack, and having a folding line for dividing the top flap into a lid portion and a tongue, and a bending line for bending a tip portion of the tongue, said bending line is located between the folding line and a tip edge of the tongue;

a pair of inner side flaps connected to both side edges of the rear wall section through folding lines, said inner side flaps serving as linings for side walls of the body of the tongue lid pack;

a pair of outer side flaps connected to both side edges of the front wall section through folding lines, said outer side flaps serving as side walls of the tongue lid pack; and a pair of inner bottom flaps arranged between said inner side flaps and said outer side flaps, and connected to said inner side flaps through folding lines, said inner bottom flaps serving as linings for the bottom wall of the tongue lid pack.

7. The blank according to claim 6, wherein each of said inner side flaps has a side end flap connected to a top edge thereof through a folding line, the top edge of said inner side flap for defining a part of the top opened end of the body.

8. A tongue lid pack, comprising:

an envelope having a tear portion defined by a separating line, said envelope for containing an article therein:

a body for surrounding the envelope so as to locate the separating line of the envelope therein, said body having a front wall, a top opened end for exposing a part of the tear portion of the envelope, and a cutting line formed on the front wall at a lower side than the separating line of the envelope; and a tongue lid hingedly connected to the top opened end, said tongue lid including a lid portion for opening and closing the top opened end, and a tongue extending from the lid portion and being insertable through the cutting line, and the tongue having a bent tip portion, said tongue and said lid portion being separated by a folding line and said bent tip portion is formed by a bending line located between the folding line and a tip edge of the tongue.

9. The pack according to claim 8, wherein the cutting line is curved convexedly to the top opened end.

10. The pack according to claim 9, wherein said tip edge is curved convexedly.

11. The pack according to claim 8, wherein said tip edge is curved convexedly.

12. The pack according to claim 8, wherein said body further includes a pair of side walls, a bottom wall, a rear wall, and a pair of side end flaps connected to top edges of said side walls, respectively, the top edges defining a part of the top opened end.

13. A blank for forming a tongue lid pack, the tongue lid pack containing a packed article which includes an envelope having a tear portion defined by a separating line, the tongue lid pack including a body with a top opened end and a tongue lid hingedly connected to the top opened end of the body and having a lid portion for opening and closing the top opened end and a tongue extending from the lid portion and being insertable through a cutting line formed on the body, said blank comprising:

a section array including a front wall section with a cutting line, a bottom wall section, and a rear wall section, said sections serving as a front wall, a bottom wall, and a rear wall for the body of the tongue lid pack, respectively, and stretching in line through folding lines, wherein the body serves for surrounding the packed article so as to locate the separating line of the packed article therein and expose a part of the tear portion of the envelope at the top opened end, and the cutting line is formed on the front wall section so as to be positioned at a lower side than the separating line when the packed article is contained in the body of the tongue lid pack;

a top flap connected to an end of said rear wall section through a folding line, said top flap serving as the tongue lid of the tongue lid pack, and having a folding line for dividing the top flap into the lid portion and the tongue, and a bending line for bending a tip portion of the tongue, said bending line is located between the folding line and a tip edge of the tongue;

a pair of inner side flaps connected to both side edges of the rear wall section through folding lines, said inner side flaps serving as linings for side walls of the body of the tongue lid pack;

a pair of outer side flaps connected to both side edges of the front wall section through folding lines, said outer side flaps serving as side walls of the body of the tongue lid pack; and a pair of inner bottom flaps arranged between said inner side flaps and said outer side flaps, and connected to said inner side flaps through folding lines, said inner bottom flaps serving as linings for the bottom wall of the body of the tongue lid pack.

* * * * *